US011069474B2

(12) United States Patent
Ooi et al.

(10) Patent No.: US 11,069,474 B2
(45) Date of Patent: Jul. 20, 2021

(54) INDUCTOR

(71) Applicant: Murata Manufacturing Co., Ltd., Kyoto-fu (JP)

(72) Inventors: Hideaki Ooi, Nagaokakyo (JP); Naotaka Hata, Nagaokakyo (JP); Kuniaki Watanabe, Nagaokakyo (JP); Hiroaki Takashima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/985,948

(22) Filed: Aug. 5, 2020

(65) Prior Publication Data

US 2021/0043365 A1 Feb. 11, 2021

(30) Foreign Application Priority Data

Aug. 6, 2019 (JP) ..... JP2019-144853

(51) Int. Cl.

| | |
|---|---|
| ***H01F 17/04*** | (2006.01) |
| ***H01F 27/29*** | (2006.01) |
| ***H01F 27/28*** | (2006.01) |
| ***H01F 41/02*** | (2006.01) |

(52) U.S. Cl.

CPC ..... *H01F 27/292* (2013.01); *H01F 17/04* (2013.01); *H01F 27/2828* (2013.01); *H01F 41/0246* (2013.01); *H01F 2017/048* (2013.01)

(58) Field of Classification Search

CPC ... H01F 17/04; H01F 2017/048; H01F 27/292
USPC ..... 336/221, 200, 223, 232
See application file for complete search history.

(56) References Cited

U.S. PATENT DOCUMENTS

| | | | | |
|---|---|---|---|---|
| 7,986,208 | B2 * | 7/2011 | Yan | H01F 27/292 336/192 |
| 8,723,629 | B1 * | 5/2014 | Liu | H01F 1/14766 336/83 |
| 10,249,429 | B2 * | 4/2019 | Arimitsu | H01F 27/292 |
| 2011/0260821 | A1 * | 10/2011 | Yamada | H01F 41/10 336/192 |
| 2012/0018205 | A1 * | 1/2012 | Sato | H01G 4/008 174/260 |
| 2014/0266541 | A1 * | 9/2014 | Sakamoto | H01F 27/30 336/192 |
| 2017/0169930 | A1 * | 6/2017 | Kudo | H01F 17/04 |

(Continued)

FOREIGN PATENT DOCUMENTS

CN 109585149 A 4/2019

*Primary Examiner* — Ronald Hinson
(74) *Attorney, Agent, or Firm* — Studebaker & Brackett PC

(57) ABSTRACT

An inductor includes a coil including a winding portion and a lead-out portion, a body constituted by a magnetic member and enclosing the coil, a protection layer disposed on a surface of the body, and an outer electrode. The body has a bottom surface, a top surface, two end surfaces, two side surfaces, and first and second R-chamfered sections. The outer electrode includes first and second electrode regions. The first electrode region is located on the bottom surface and is electrically connected to the lead-out portion. The second electrode region is located on the protection layer on each end surface. The surface roughness of part of the bottom surface where the first electrode region is disposed is greater than that of the protection layer on each of the end surfaces where the second electrode region is disposed.

20 Claims, 7 Drawing Sheets

(56) References Cited

U.S. PATENT DOCUMENTS

| | | | | |
|---|---|---|---|---|
| 2018/0337001 | A1* | 11/2018 | Tozawa | H01G 4/232 |
| 2019/0326041 | A1* | 10/2019 | Kawaguchi | H01F 1/06 |
| 2019/0348212 | A1* | 11/2019 | Tozawa | H01F 27/29 |
| 2019/0362883 | A1* | 11/2019 | Kang | H01F 17/0013 |
| 2020/0251283 | A1* | 8/2020 | Onodera | H01G 4/248 |
| 2020/0312551 | A1* | 10/2020 | Nagai | H01G 4/2325 |

* cited by examiner

INDUCTOR

CROSS-REFERENCE TO RELATED APPLICATION

This application claims benefit of priority to Japanese Patent Application No. 2019-144853, filed Aug. 6, 2019, the entire content of which are incorporated herein by reference.

BACKGROUND

Technical Field

The present disclosure relates to an inductor.

Background Art

Chinese Patent Application Publication No. 109585149 discloses the following inductor. The inductor includes a core, a wire, and a magnetic exterior unit. The core is formed by cold working. The wire includes a coil segment wound around the core and end portions extending in opposite directions from the coil segment. The magnetic exterior unit is formed by hot press forming and covers at least the core and the coil segment. In this inductor, the end portions of the wire extend from the side surfaces of the magnetic exterior unit and bend along the bottom surface, thereby forming outer electrodes.

SUMMARY

The outer electrodes of the inductor disclosed in the above-described publication has only a small area. For this reason, the inductor may not be able to exhibit a sufficient adhesion strength to a mounting substrate.

Accordingly, the present disclosure provides an inductor which is able to exhibit a high adhesion strength to a mounting substrate.

According to an aspect of the present disclosure, there is provided an inductor including a coil, a body, a protection layer, and an outer electrode. The coil includes a winding portion and a lead-out portion. The winding portion is formed by winding a conductor. The lead-out portion extends from the winding portion. The body is constituted by a magnetic member including magnetic powder and a resin and encloses the coil. The protection layer is disposed on a surface of the body. The outer electrode is electrically connected to the lead-out portion. The body has a bottom surface, a top surface, two end surfaces, two side surfaces, and first and second R-chamfered (round chamfered) sections. The bottom surface serves as a mounting surface. The top surface opposes the bottom surface. The two end surfaces oppose each other and are substantially perpendicular to the bottom surface. The two side surfaces oppose each other and are substantially perpendicular to the bottom surface and the end surfaces. The first R-chamfered section is disposed at a ridge portion between the bottom surface and each of the end surfaces. The second R-chamfered section is disposed at a ridge portion between each of the end surfaces and the corresponding side surface. The outer electrode includes first and second electrode regions. The first electrode region is at least located on at least part of the bottom surface and is electrically connected to the lead-out portion. The second electrode region is at least located on at least part of the protection layer disposed on each of the end surfaces. The surface roughness of part of the bottom surface where the first electrode region is disposed is greater than that of the protection layer on each of the end surfaces where the second electrode region is disposed.

According to an aspect of the present disclosure, it is possible to provide an inductor which is able to exhibit a high adhesion strength to a mounting substrate.

Other features, elements, characteristics and advantages of the present disclosure will become more apparent from the following detailed description of preferred embodiments of the present disclosure with reference to the attached drawings.

DETAILED DESCRIPTION

Figure 1A:
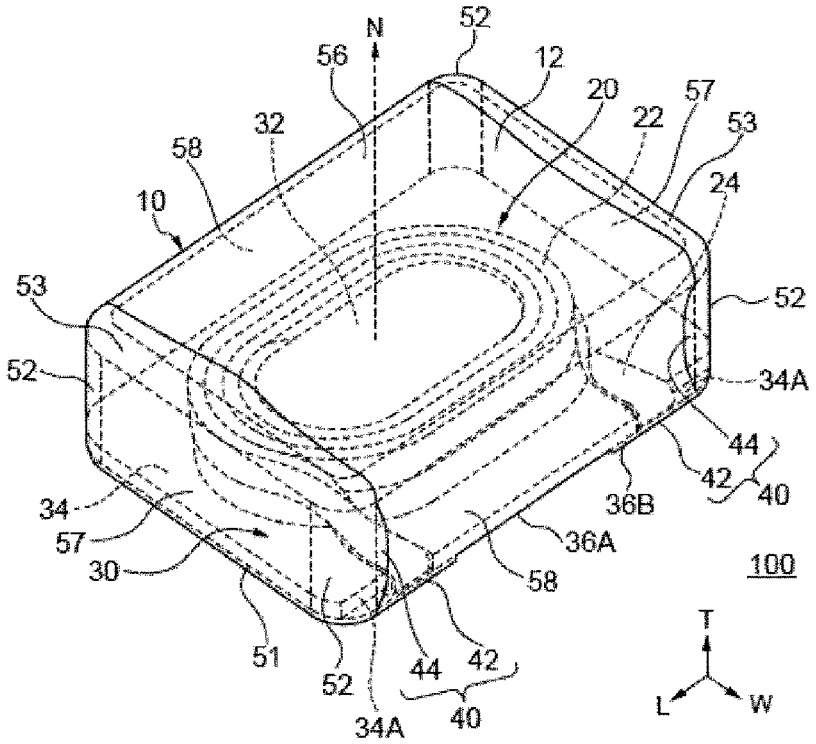
FIG. 1A is a partially transparent perspective view of an inductor according to a first embodiment when the top surface is seen obliquely from above.

An inductor includes a coil, a body, a protection layer, and an outer electrode. The coil includes a winding portion and a lead-out portion. The winding portion is formed by winding a conductor. The lead-out portion extends from the winding portion. The body is constituted by a magnetic member including magnetic powder and a resin and encloses the coil. The protection layer is disposed on a surface of the body. The outer electrode is electrically connected to the lead-out portion. The body has a bottom surface, a top surface, two end surfaces, two side surfaces, and first and second R-chamfered sections. The bottom surface serves as a mounting surface. The top surface opposes the bottom surface. The two end surfaces oppose each other and are substantially perpendicular to the bottom surface. The two side surfaces oppose each other and are substantially perpendicular to the bottom surface and the end surfaces. The first R-chamfered section is disposed at a ridge portion between the bottom surface and each of the end surfaces. The second R-chamfered section is disposed at a ridge portion between each of the end surfaces and the corresponding side surface. The outer electrode includes first and second electrode regions. The first electrode region is at least located on at least part of the bottom surface and is electrically connected to the lead-out portion. The second electrode region is at least located on at least part of the protection layer disposed on each of the end surfaces. The surface roughness of part of the bottom surface where the first electrode region is disposed is greater than that of the protection layer on each of the end surfaces where the second electrode region is disposed.

The outer electrode is formed by disposing the first electrode region on the bottom surface of the body and the second electrode region on each of the end surfaces, thereby enhancing the adhesion strength of the inductor to a mounting substrate. Higher roughness of the bottom surface on which the first electrode region is disposed enhances the mechanical bonding strength of the first electrode region to the body due to the anchor effect. This can further improve the reliability of the inductor mounted on a substrate.

The second electrode region may extend on the protection layer disposed on each of the end surfaces, on the first R-chamfered section continuing to each of the end surfaces, on part of the bottom surface continuing to the first R-chamfered section, on the second R-chamfered section continuing to each of the end surfaces, and on part of each of the side surfaces continuing to the second R-chamfered section. As a result of disposing the second electrode region over the bottom surface, each end surface, and each side surface of the body, the adhesion strength of the inductor to a mounting substrate can be further enhanced.

The second electrode region may extend on the protection layer disposed on each of the end surfaces, on the first R-chamfered section continuing to each of the end surfaces, on part of the bottom surface continuing to the first R-chamfered section, and on part of the second R-chamfered section continuing to each of the end surfaces. The forward end of the second electrode region closer to each of the side surfaces of the body is disposed on the second R-chamfered section, and the second electrode region is not disposed on the side surfaces of the body, thereby achieving higher-density mounting of the inductor in the direction of the side surfaces.

The second electrode region may extend on the protection layer disposed on each of the end surfaces, on part of the first R-chamfered section continuing to each of the end surfaces, and on part of the second R-chamfered section continuing to each of the end surfaces. The forward end of the second electrode region closer to the bottom surface of the body is disposed on the first R-chamfered section, and the second electrode region is not disposed on the bottom surface of the body, thereby further improving the flatness of the mounting surface of the inductor.

The first electrode region may extend on part of the bottom surface and on the first R-chamfered section continuing to the bottom surface. The second electrode region may be electrically connected to the first electrode region on the first R-chamfered section. Because of electrical connection between the first and second electrode regions on the first R-chamfered section, while improving the flatness of the mounting surface of the inductor, the adhesion strength of the inductor to a mounting substrate can be further enhanced.

The second electrode region may not be disposed on the top surface. Even if a metal shielding is disposed above the inductor, short-circuiting is less likely to occur.

The second electrode region may be disposed on part of each of the end surfaces located closer to the bottom surface, and the protection layer may be exposed on part of each of the end surfaces located closer to the top surface. While the adhesion strength of the inductor to a mounting substrate is achieved, short-circuiting is even less likely to occur even if a metal shielding is disposed above the inductor.

The second electrode region may extend on the protection layer disposed on each of the end surfaces, on the first R-chamfered section continuing to each of the end surfaces, and on part of the top surface. This can further improve the flatness of the mounting surface of the inductor. Additionally, increasing the area of the second electrode region can further enhance the adhesion strength of the inductor to a mounting substrate.

The number of conductive particles included in the first electrode region which intersect with a unit length of a straight line perpendicular to the bottom surface may greater than that in the second electrode region which intersect with a unit length of a straight line perpendicular to the end surfaces. That is, the first electrode region may contain more conductive particles than the second electrode region. Providing more conductive particles in the first electrode region can reduce the direct current (DC) resistance at the portion where the lead-out portion of the coil is electrically connected to a wiring pattern on a mounting substrate. Providing fewer conductive particles in the second electrode region increases the content ratio of a resin in the second electrode region, thereby improving the mechanical bonding strength of the second electrode region to the body. This can enhance the mechanical bonding strength of the inductor to the mounting substrate.

For example, the first electrode region is formed by using conductive particles having a small particle size, thereby making it possible to provide more conductive particles in the first electrode region. The second electrode region is formed by using conductive particles having a large particle size, thereby making it possible to provide fewer conductive particles in the second electrode region. Using conductive particles having a large particle size to form the second electrode region can reduce the manufacturing cost and contribute to improving the productivity.

The radius of curvature for implementing arc approximation to determine an outer peripheral configuration of the first R-chamfered section in a cross section perpendicular to the bottom surface and the end surfaces may be smaller than that to determine an outer peripheral configuration of the second R-chamfered section in a cross section perpendicular to the end surfaces and the side surfaces. The smaller radius of curvature of the first R-chamfered section can effectively reduce the occurrence of the tombstone phenomenon in which an inductor pivots with one side soldered to a mounting substrate and the other side standing up when the inductor is mounted on the substrate. The larger radius of curvature of the second R-chamfered section can reduce the surface tension in the direction of the side surfaces when forming the second electrode region with a paste. This can reduce the amount of second electrode region extending to the side surfaces of the body.

In this specification, "step" refers to, not only an independent step, but also a step that may not be clearly distinguished from the other steps but still can fulfill an intended purpose of executing this step.

Embodiments of the disclosure will be described below with reference to the accompanying drawings. Inductors that will be discussed below are merely examples for substantiating the technical idea of the disclosure, and the disclosure is not restricted to these inductors. Elements and members that may be used in the disclosure are not limited to those described in the embodiments. In particular, the dimensions, materials, shapes, and relative positions of the elements and members described in the embodiments are only examples unless otherwise stated. In the individual drawings, identical elements or identical members are designated by like reference numeral. For the sake of facilitating an explanation and understanding of the main points of the disclosure, the disclosure will be described through illustration of different embodiments. Nevertheless, the configurations described in the different embodiments may partially be replaced by or combined with each other. Second through fifth embodiments will be described mainly by referring to points different from a first embodiment while omitting the same points as the first embodiment. An explanation of similar advantages obtained by similar configurations will not be repeated.

The disclosure will be described specifically through illustration of embodiments. The disclosure is not however restricted to these embodiments.

First Embodiment

Figure 1B:
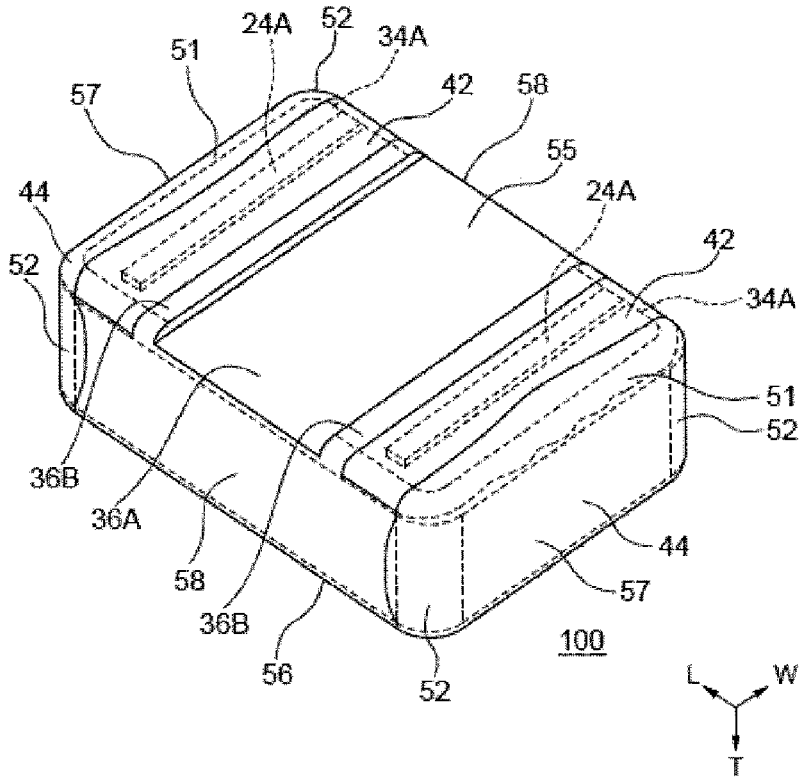
FIG. 1B is a partially transparent perspective view of the inductor according to the first embodiment when the mounting surface is seen obliquely from above.
Figure 2A:
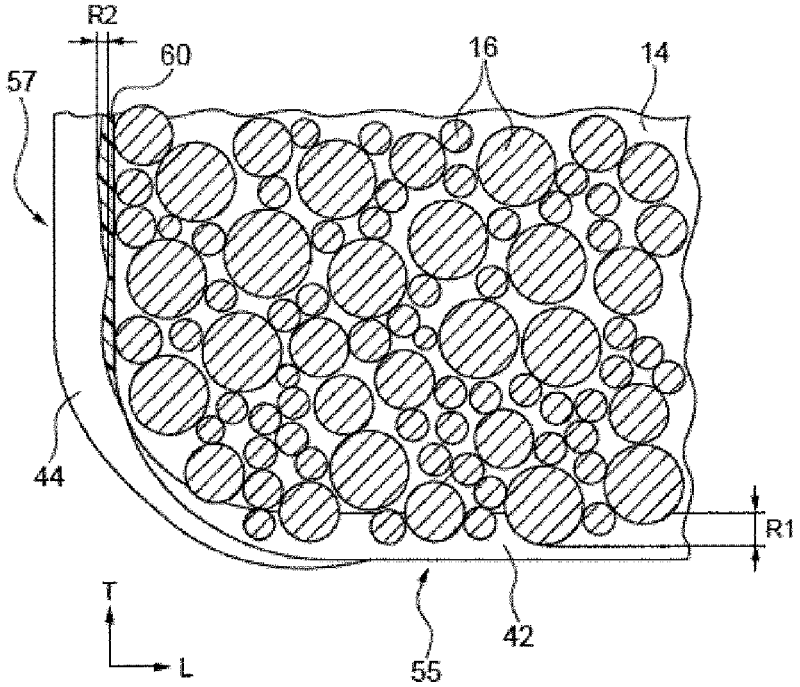
FIG. 2A is a partially sectional view of an outer electrode and its vicinity on a surface perpendicular to the bottom surface and the end surface of the inductor.

An inductor 100 according to a first embodiment will be described below with reference to FIGS. 1A, 1B, and 2A. FIG. 1A is a partially transparent perspective view of the inductor 100 when the top surface is seen obliquely from above. FIG. 1B is a partially transparent perspective view of the inductor 100 when the mounting surface is seen obliquely from above. FIG. 2A is a partially sectional view of an outer electrode 40 and its vicinity on a surface perpendicular to the bottom surface and an end surface of the inductor 100. In FIGS. 1A and 1B and some of the other drawings, broken lines may be used as auxiliary lines representing curved surfaces.

As shown in FIGS. 1A and 1B, the inductor 100 includes a coil 20, a body 10, a protection layer 12, and outer electrodes 40. The coil 20 includes a winding portion 22 formed by winding a conductor and a pair of lead-out portions 24 extending from the winding portion 22. The body 10 is constituted by a magnetic member and encloses the coil 20. The protection layer 12 is disposed on the surfaces of the body 10. The outer electrodes 40 are electrically connected to the corresponding lead-out portions 24 of the coil 20.

The body 10 has a bottom surface 55, a top surface 56, two end surfaces 57, and two side surfaces 58. The bottom surface 55 serves as the mounting surface of the inductor 100. The top surface 56 opposes the bottom surface 55 in a height T direction. The two end surfaces 57 are substantially perpendicular to the bottom surface 55 and oppose each other in a length L direction. The two side surfaces 58 are substantially perpendicular to the bottom surface 55 and the end surfaces 57 and oppose each other in a width W direction. The body 10 includes a planar base unit 34 and a columnar unit 32 disposed substantially perpendicularly to the base unit 34. The body 10 is constituted by a magnetic base 30, the coil 20, and a magnetic exterior unit. The magnetic base 30 and the magnetic exterior unit each contain magnetic powder. The winding portion 22 of the coil 20 is wound around the columnar unit 32. The magnetic exterior unit covers the coil 20 and the magnetic base 30.

The coil 20 has a coating layer and is constituted by a conductor. The conductor has a pair of opposing flat surfaces and side surfaces adjacent to the pair of flat surfaces. The above-described type of conductor is called flat wire. The winding portion 22 of the coil 20 is formed by winding the conductor around the columnar unit 32 in an upper-lower two-stage spiral shape. More specifically, in this two-stage spiral coil, the end portions of the conductor are positioned at the outermost peripheral side and the inner portions of the conductor are connected with each other at the innermost peripheral side. The coil winding type of this two-stage spiral shape is called alpha ($\alpha$) winding. The inner peripheral surface of the winding portion 22 contacts the surface of the columnar unit 32. The winding portion 22 is disposed such that the winding axis N intersects with the bottom surface 55 of the body 10 substantially at right angles. The pair of lead-out portions 24 are formed continuously from the corresponding end portions of the conductor positioned at the outer peripheral side of the winding portion 22. The pair of lead-out portions 24 extend toward one side surface 58 of the body 10 while being twisted in different directions at about 90° such that the flat surfaces are substantially parallel with the surface of the base unit 34. The lead-out portions 24 are then stored in notches 34A formed in the base unit 34 and bend toward the bottom surface 55. The end portions of the lead-out portions 24 extend along projecting portions 36B on the bottom surface 55. The lead-out portions 24 disposed along the projecting portions 36B have flat portions 24A having a larger width than the line width of the conductor and a smaller thickness than that of the conductor. The flat portions 24A without the coating layer peeled off are exposed on the bottom surface 55. The end portions of the conductor located at the boundary between the lead-out portions 24 and the flat portions 24A are stored in the notches 34A.

A cross section substantially perpendicular to the longitudinal direction of the conductor forming the coil 20 is a substantially rectangle, for example. The rectangle is defined by the width of the flat surface, which corresponds to the long side of the rectangle, and the thickness, which is the distance between the flat surfaces and corresponds to the short side of the rectangle. The conductor is made of a conductive metal, such as copper. The width of the conductor is about 140 to 170 μm, for example, and the thickness is about 67 to 85 μm, for example. The coating layer of the conductor is made of an insulating resin, such as polyimide or polyamide-imide, having a thickness of about 2 to 10 μm, and more preferably, about 2, 4, 6, 8, or 10 μm. On the surface of the coating layer, a self-fusion-bonding layer containing a self-fusion-bonding component, such as a thermoplastic resin or a thermosetting resin, may also be formed. The thickness of such a self-fusion-bonding layer may be about 1 to 3 μm.

The body 10 has a first R-chamfered section 51 at the ridge portion between each end surface 57 and the bottom surface 55 and a second R-chamfered section 52 at the ridge portion between each end surface 57 and the corresponding side surface 58. A recessed portion 36A, which serves as a standoff, is formed at the central portion of the bottom surface 55 of the body 10 in the length L direction. The recessed portion 36A passes through the bottom surface 55 in the width W direction. The projecting portions 36B are disposed at both sides of the recessed portion 36A in the length L direction so as to sandwich the recessed portion 36A therebetween. In the inductor 100, as viewed from the width W direction, the shape of the recessed portion 36A in the height T direction is formed in a substantially rectangle. The planar portion, which is the bottom of the recessed portion 36A, and the planar portion, which is the top of each projecting portion 36B, are formed substantially in parallel with each other. The depth of the recessed portion 36A is about 20 to 60 μm or about 20 to 50 μm. If the depth of the recessed portion 36A is about 20 μm or greater, the body 10 between the outer electrodes 40 is less likely to contact a mounting substrate and can accommodate a deflection of the substrate. If the depth of the recessed portion 36A is about 60 μm or smaller, the volume of the inductor 100 does not become too small, thereby maintaining the characteristics of the inductor 100.

The magnetic base 30 forming the body 10 is constituted by a magnetic member including magnetic powder and a resin. The base unit 34 has a planar shape similar to the bottom surface 55 of the body 10. The base unit 34 is formed substantially in a rectangular shape and has curved surfaces at the corners in accordance with the second R-chamfered sections 52. A cross section of the columnar unit 32 parallel with the surface of the base unit 34 has a substantially oval shape. At both ends of the long side of the base unit 34 corresponding to the side surface 58 of the body 10, the notches 34A, which are formed substantially in a rectangular shape, are provided to store the lead-out portions 24 of the coil 20. The magnetic exterior unit is constituted by a magnetic member including magnetic powder and a resin, and covers the magnetic base 30 and the coil 20 so as to form the body 10.

The body 10 is formed substantially in a rectangular parallelepiped, for example. The body 10 has a length L of about 1 to 3.4 mm, and more preferably, about 1 to 3 mm, a width W of about 0.5 to 2.7 mm, and more preferably, 0.5 to 2.5 mm, and a height T of about 0.5 to 2 mm, and more preferably, 0.5 to 1.5 mm. The specific dimensions (L×W×T) of the body 10 are, for example, 1 mm×0.5 mm×0.5 mm, 1.6 mm×0.8 mm×0.8 mm, 2 mm×1.2 mm×1 mm, or 2.5 mm×2 mm×1.2 mm.

The magnetic member forming the body 10 is made of a composite material containing magnetic powder and a binder, such as a resin. Examples of the magnetic powder are metal magnetic powder containing iron, such as Fe, Fe—Si, Fe—Ni, Fe—Si—Cr, Fe—Si—Al, Fe—Ni—Al, Fe—Ni—Mo, and Fe—Cr—Al, other compositions of metal magnetic powder, amorphous metal magnetic powder, and metal magnetic powder coated with an insulator, such as glass, metal magnetic powder subjected to surface modification, and nano-size metal magnetic powder. As the resin, which is an example of the binder, a thermosetting resin, such as an epoxy resin, a polyimide resin, and a phenolic resin, or a thermoplastic resin, such as a polyethylene resin, a polyamide resin, and a liquid crystal polymer, is used. The packing factor of magnetic powder forming the composite material is about 50 to 85 percentage by weight (wt %), and more preferably, 60 to 85 wt % or 70 to 85 wt %.

The protection layer 12 is disposed on the surface of the body 10. The protection layer 12 covers the surfaces of the body 10 other than the areas where first electrode regions 42, which will be discussed later, are formed. The protection layer 12 includes a resin, for example. Examples of the resin forming the protection layer 12, are a thermosetting resin, such as an epoxy resin, a polyimide resin, and a phenolic resin, and a thermoplastic resin, such as an acrylic resin, a polyethylene resin, and a polyamide resin. The protection layer 12 may contain a filler. As the filler, a non-conductive filler, such as silicon oxide or titanium oxide, is used. The protection layer 12 is formed on the body 10 by disposing a resin composition containing a resin and a filler on the surface of the body 10 by coating or dipping, for example, and by curing the resin if necessary.

A marker, which indicates the polarity of the inductor 100, may be provided on the body 10 by printing or laser engraving. A marker is provided on the top surface 56 on the side close to the side surface 58 to which the lead-out portions 24 extend from the lower stage of the winding portion 22.

Each outer electrode 40 includes a first electrode region 42 and a second electrode region 44. The first electrode region 42 is disposed at least on the projecting portion 36B on the bottom surface 55 and is electrically connected to the lead-out portion 24 of the coil 20. The second electrode region 44 is disposed at least on the protection layer 12 of the end surface 57. The first electrode region 42 is disposed on the bottom surface 55 of the body 10 without the protection layer 12 thereon, and more specifically, in the area where at least part of the projecting portion 36B without the protection layer 12 is disposed and the flat portion 24A of the lead-out portion 24 is exposed on the body 10. With this configuration, the first electrode region 42 is electrically connected to the flat portion 24A, which is an end portion of the lead-out portion 24 disposed along the projecting portion 36B. The second electrode region 44 is disposed on the protection layer of the end surface 57 of the body 10 and around the end surface 57.

The outer electrode 40 may have a plated layer on the first and second electrode regions 42 and 44. The plated layer may be constituted by a nickel-plated layer on the first and second electrode regions 42 and 44 and a tin-plated layer on the nickel-plated layer. The thickness of the nickel-plated layer may be about 4 to 7 μm. The thickness of the tin-plated layer may be about 6 to 12 μm.

In the inductor 100, the first electrode region 42 extends on the projecting portion 36B on the bottom surface 55 of the body 10 and on the first R-chamfered section 51 continuing to the bottom surface 55. The second electrode region 44 extends on each end surface 57 of the body 10, on the first R-chamfered section 51 continuing to each end surface 57, on part of the bottom surface 55 continuing to the first R-chamfered section 51, on the second R-chamfered sections 52 continuing to both sides of each end surface 57, and on part of each side surface 58 continuing to the second R-chamfered section 52. The first and second electrode regions 42 and 44 are both disposed on the bottom surface 55 and on the first R-chamfered section 51 so that they can be electrically connected with each other. As shown in FIG. 1A, the second electrode region 44 also extends on a third R-chamfered section 53 provided at the ridge portion between each end surface 57 and the top surface 56 and on part of the top surface 56 continuing to the third R-chamfered section 53.

The first and second electrode regions 42 and 44 each contain conductive particles, such as silver particles and copper particles. The conductive particles may be flake-like particles, substantially spherical particles, or a mixture thereof. The conductive particles may be particles bound each other via the complex redox reaction. The first and second electrode regions 42 and 44 may contain a binder, such as a resin, in addition to the conductive particles. If the first electrode regions 42 contain a binder, the volume ratio of the conductive particles in the first electrode regions 42 is about 35 to 85%. If the second electrode regions 44 contain a binder, the volume ratio of the conductive particles in the second electrode regions 44 is about 30 to 80%. The volume ratio of the conductive particles in each of the first and second electrode regions 42 and 44 may be determined as the area ratio of the conductive particles to the area of the first or second electrode regions 42 or 44 on a cross section of the first or second electrode regions 42 or 44.

The thickness of the first electrode region 42 is about 1 to 15 μm. The thickness of the second electrode region 44 is about 2 to 30 μm. The adhesion strength of the inductor 100 to a mounting substrate can be enhanced by forming the second electrode region 44 thick, while the direct current (DC) resistance can be reduced by forming the first electrode region 42 thin.

The first electrode regions 42 are formed by applying a conductive paste containing conductive particles and a resin to certain areas by coating, printing, transferring, or jet-dispensing, for example. The applied conductive paste may be cured, if necessary. The second electrode regions 44 are formed by applying a conductive paste to certain areas by dipping, coating, transferring, or jet-dispensing, for example. The applied conductive paste may be cured, if necessary.

The number of conductive particles contained in the first electrode regions 42 is greater than that in the second electrode regions 44. Providing more conductive particles in the first electrode regions 42 can reduce the DC resistance of the first electrode regions 42 and accordingly reduces that of the inductor 100. Providing fewer conductive particles in the second electrode regions 44 increases the content ratio of the binder to the conductive particles, thereby improving the binding force of the second electrode regions 44 to the protection layer 12. This further enhances the adhesion strength of the inductor 100 to a mounting substrate. In this specification, the number of conductive particles in the first electrode regions 42 intersecting with the unit length of straight lines drawn perpendicularly to the bottom surface 55 is used as the number of conductive particles contained in the first electrode regions 42. Concerning the number of conductive particles contained in the second electrode regions 44, the number of conductive particles in the second electrode regions 42 intersecting with the unit length of straight lines drawn perpendicularly to the end surfaces 57 is used as the number of conductive particles contained in the second electrode regions 44.

The number of conductive particles contained in the first electrode regions 42 and that in the second electrode regions 44 may be adjusted by the content ratio of conductive particles in the conductive paste or by the size of the conductive particles. For example, if the volume ratio of the conductive particles in the conductive paste forming the first electrode regions 42 and that of the second electrode regions 44 are roughly the same, the size of the conductive particles contained in the first electrode regions 42 is formed smaller than that in the second electrode regions 44. This can provide more conductive particles in the first electrode regions 42 than in the second electrode regions 44.

The number of conductive particles in the first electrode regions 42 intersecting with the unit length of straight lines drawn perpendicularly to the bottom surface 55, and the number of conductive particles in the second electrode regions 44 intersecting with the unit length of straight lines drawn perpendicularly to the end surfaces 57 can be determined in the following manner. Scanning electron microscope (SEM) images are taken for cross sections of each of the first and second electrode regions 42 and 44 in the thickness direction at a magnification factor of 5000, for example. Auxiliary lines are drawn at three SEM images in the thickness direction of each of the first and second electrode regions 42 or 44 so as to measure the numbers of particles intersecting with the auxiliary lines. The numbers of particles are converted into those per 1-μm length of the auxiliary lines. Then, these numbers are subjected to arithmetic mean, and the resulting value is set as the number of conductive particles contained in each of the first and second electrode regions 42 or 44. The number of conductive particles determined in this manner will also be called the average number of intersecting particles.

Figure 3A:
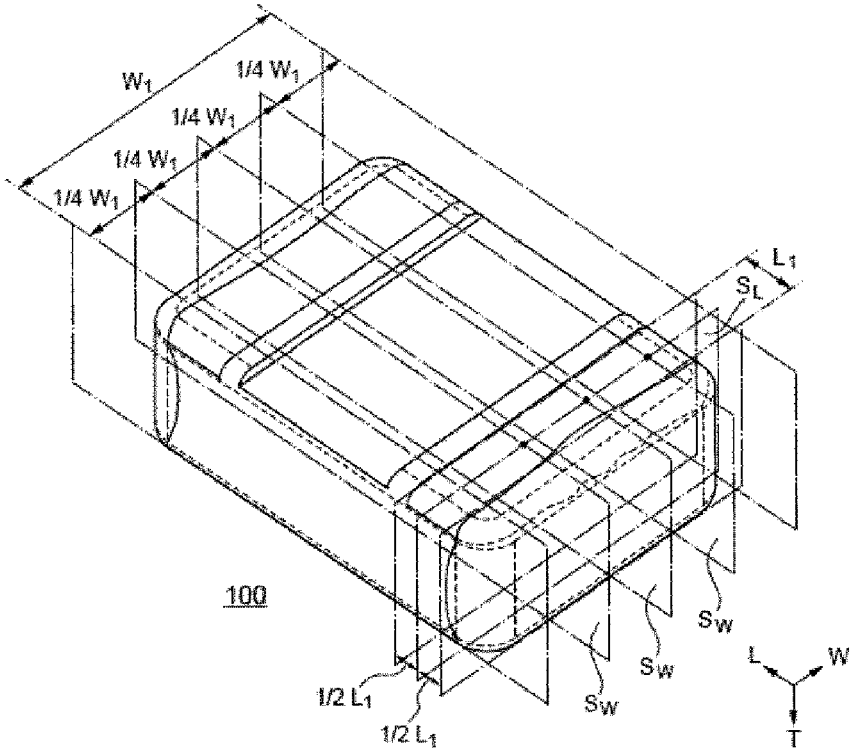
FIG. 3A is a perspective view illustrating the position at which the average number of intersecting particles in first electrode regions of the inductor is calculated.

More specifically, the average number P of intersecting particles in the first electrode regions 42 can be determined as follows. As shown in FIG. 3A, the dimension $W_1$ of the first electrode region 42 in the width W direction of the body 10 is equally divided into four portions, and SEM images are taken for three cross sections $S_W$ perpendicular to the bottom surface 55 and the end surfaces 57. As shown in FIG. 3A, the dimension $L_1$ of the first electrode region 42 in the length L direction of the body 10 is equally divided into two portions. On the intersecting line (positions indicated by the black dots in FIG. 3A) between a cross section $S_L$ perpendicular to the bottom surface 55 and the side surfaces 58 and the cross sections $S_W$, auxiliary lines having a predetermined length are drawn in the thickness direction of the first electrode region 42, that is, in the direction perpendicular to the bottom surface 55. The numbers of conductive particles intersecting with the auxiliary lines are measured and are converted into those per 1-μm length of the auxiliary lines. Then, these numbers obtained for the three SEM images are subjected to arithmetic mean, thereby determining the average number P of intersecting particles in the first electrode regions 42. The dimension $W_1$ of the first electrode region 42 is determined from a projection plan view seen from the bottom surface 55, while the dimension $L_1$ of the first electrode region 42 is determined from a projection plan view seen from the side surface 58.

Figure 3B:
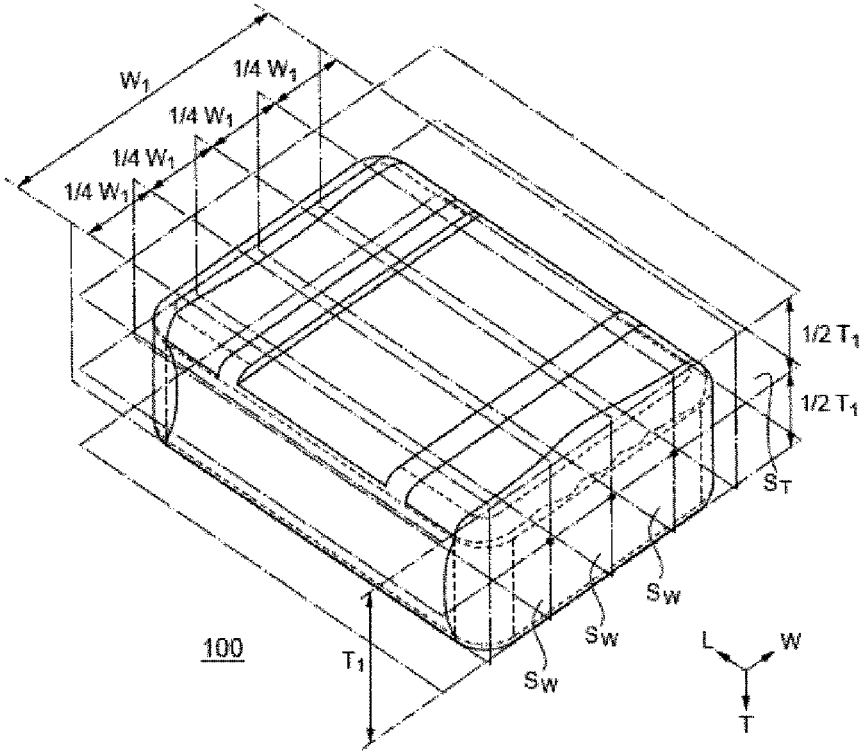
FIG. 3B is a perspective view illustrating the position at which the average number of intersecting particles in second electrode regions of the inductor is calculated.

The average number Q of intersecting particles in the second electrode regions 44 can be determined as follows. As shown in FIG. 3B, the dimension $W_1$ of the second electrode region 44 in the width W direction of the body 10 is equally divided into four portions, and SEM images are taken for three cross sections $S_W$ perpendicular to the bottom surface 55 and the end surfaces 57. As shown in FIG. 3B, the dimension $T_1$ of the second electrode region 44 in the height H direction of the body 10 is equally divided into two portions. On the intersecting line (positions indicated by the black dots in FIG. 3B) between a cross section $S_T$ perpendicular to the end surfaces 57 and the side surfaces 58 and the cross sections $S_W$, auxiliary lines having a predetermined length are drawn in the thickness direction of the second electrode region 44, that is, in the direction perpendicular to the end surfaces 57. The numbers of conductive particles intersecting with the auxiliary lines are measured and are converted into those per 1-μm length of the auxiliary lines. Then, these numbers obtained for the three SEM images are subjected to arithmetic mean, thereby determining the average number Q of intersecting particles in the second electrode regions 44. The dimension $W_1$ of the second electrode region 44 is determined from a projection plan view seen from the bottom surface 55, while the dimension $T_1$ of the second electrode region 44 is determined from a projection plan view seen from the end surface 57.

The average number P of intersecting particles is at least one, and more preferably, about 1.2 or greater or about 1.3 or greater. The upper limit of the average number P is about 3 or smaller, and more preferably, about 2 or smaller or about 1.6 or smaller. The average number P may be about 1 to 3. When the average number P is within this range, the DC resistance of the inductor 100 can be reduced to be even smaller.

The average number Q of intersecting particles is about 0.3 or greater, and more preferably, about 0.4 or greater or about 0.5 or greater. The upper limit of the average number Q is smaller than one, and more preferably, about 0.9 or smaller or about 0.8 or smaller. The average number Q may be about 0.3 or greater and smaller than one. When the average number Q is within this range, the adhesion strength of the inductor 100 to a mounting substrate can be enhanced to be even higher.

The ratio of the average number P to the average number Q is about 1.1 or higher, and more preferably, about 1.2 or higher or about 1.5 or higher. The ratio of the average number P to the average number Q is about 3.5 or lower, and more preferably, about 2.5 or lower or about 2 or lower. The ratio of the average number P to the average number Q may be about 1.1 to 3.5. When the ratio of the average number P to the average number Q is within this range, the inductor 100 achieves a low DC resistance and a high adhesion strength in a well-balanced manner.

The size of the conductive particles contained in the first electrode regions 42 may be smaller than that in the second electrode regions 44. If the volume ratio of the conductive particles in the first electrode regions 42 and that in the second electrode regions 44 are roughly the same, the size of the conductive particles contained in the first electrode regions 42 is formed smaller than that in the second electrode regions 44. This increases the contact area of each other's conductive particles in the first electrode regions 42, thereby reducing the DC resistance of the inductor 100. Large conductive particles in the second electrode regions 44 increases the content ratio of the binder to the conductive particles, thereby improving the binding force of the second electrode regions 44 to the protection layer 12. This further enhances the adhesion strength of the inductor 100 to a mounting substrate. Using inexpensive large conductive particles can also reduce the manufacturing cost.

The size of conductive particles contained in each of the first and second electrode regions 42 and 44 can be measured in the following manner without using a particle size analyzer. If conductive particles are substantially spherical, the particle size is determined as follows. An SEM image is taken for a cross section of 10 μm×10 μm size of each of the first and second electrode regions 42 and 44. Then, the sectional area of each of the particles observed in the cross section is measured, and the diameter of the sectional area of each particle, which is assumed as a circle, is calculated. If the first or second electrode regions 42 or 44 contain flake-like conductive particles, the particle size can be indirectly measured in a manner similar to the above-described approach to determining the number of conductive particles intersecting with the unit length of the auxiliary lines. This is based on the assumption that, as more particles are observed, the particle size is smaller.

The surface roughness of the bottom surface 55 on which the first electrode regions 42 are formed is higher than that of the protection layer 12 on the end surfaces 57 on which the second electrode regions 44 are formed. Higher roughness of the bottom surface 55 having the first electrode regions 42 thereon enhances the bonding strength of the first electrode regions 42 to the body 10 due to the anchor effect. This can further improve the reliability of the inductor 100 to be mounted on a substrate.

As in the partially sectional view of the outer electrode 40 and its vicinity shown in FIG. 2A, on the bottom surface 55 of the body 10 constituted by the magnetic member including magnetic powders 16 and a resin 14, part of the resin 14 forming a protection layer 60 and the magnetic member is removed, thereby partially exposing the magnetic powders 16 embedded in the resin 14. Partially exposing the magnetic powders 16 increases the degree of surface roughness in the area where the first electrode regions 42 are formed. The surface roughness in the area where the first electrode region 42 is formed can be defined by the largest value R1, which corresponds to the largest level of the unevenness on the bottom surface 55 measured based on the surface parallel with the recessed portion 36A. The largest value R1 can be measured as the distance between the point in the height T direction of the body 10 closest to the surface on the recessed portion 36A and the point farthest from this surface.

As shown in FIG. 2A, the end surface 57 of the body 10 is coated with the protection layer 60 having a nonuniform thickness, and the second electrode region 44 is formed on the protection layer 60, on the first R-chamfered section 51, and on part of the first electrode region 42. The surface roughness in the area where the second electrode region 44 is formed can be defined by the largest value R2, which corresponds to the largest level of the unevenness in the thickness direction of the protection layer 60. The largest value R2 can be measured as the difference between the largest thickness and the smallest thickness of the protection layer 60 from the end surface 57 of the body 10 in the length L direction of the body 10.

The surface roughness in the area where each of the first and second electrode regions 42 and 44 is formed can be determined in the following manner.

The surface roughness in the area where the first electrode regions 42 are formed is determined as follows. SEM images are taken for cross sections perpendicular to the end surfaces 57 and the bottom surface 55 where the first electrode regions 42 are formed at a magnification factor of 500, for example. On three SEM images, auxiliary lines having a length of about 150 μm are drawn perpendicularly to the end surfaces 57 and the side surfaces 58 of the body 10. For sectional configurations within the range of the auxiliary lines, the largest levels of the unevenness on the bottom surface 55 in the thickness T direction of the body 10 are measured and are then subjected to arithmetic mean. The resulting average value is set as the surface roughness in the area where the first electrode regions 42 are formed.

More specifically, as shown in FIG. 3A, the dimension $W_1$ of the first electrode region 42 in the width W direction of the body 10 is equally divided into four portions, and the surface roughness in the area where the first electrode regions 42 are formed is measured on the three cross sections $S_W$ perpendicular to the bottom surface 55 and the end surfaces 57. The measurement positions on the cross sections $S_W$ are set as follows. As shown in FIG. 3A, the dimension $L_1$ of the first electrode region 42 in the length L direction of the body 10 is equally divided into two portions. Then, the cross section $S_L$ perpendicular to the bottom surface 55 and the side surfaces 58 is set at the dividing position of the dimension $L_1$. The surface roughness is measured around the positions at which the cross section $S_L$ and the cross sections $S_W$ intersect with each other and at which the conductor forming the coil 20 is not disposed.

The surface roughness in the area where the second electrode regions 44 are formed is determined as follows.

SEM images are taken similarly to those for determining the surface roughness concerning the first electrode regions 42. On three SEM images, auxiliary lines having a length of about 150 μm are drawn perpendicularly to the bottom surface 55 and the end surfaces 57 of the body 10. For sectional configurations within the range of the auxiliary lines, the largest levels of the unevenness of the protection layer in the length L direction of the body 10 are measured and are then subjected to arithmetic mean. The resulting average value is set as the surface roughness in the area where the second electrode regions 44 are formed.

More specifically, as shown in FIG. 3B, the dimension $W_1$ of the second electrode region 44 in the width W direction of the body 10 is equally divided into four portions, and the surface roughness in the area where the second electrode regions 44 are formed is measured on the three cross sections $S_W$ perpendicular to the bottom surface 55 and the end surfaces 57. The measurement positions on the cross sections $S_W$ are set as follows. As shown in FIG. 3B, the dimension $T_1$ of the second electrode region 44 in the height T direction of the body 10 is equally divided into two portions. Then, the cross section $S_T$ perpendicular to the end surfaces 57 and the side surfaces 58 is set at the dividing position of the dimension $T_1$. The surface roughness is measured around the positions at which the cross section $S_T$ and the cross sections $S_W$ intersect with each other.

The surface roughness in the area where the first electrode regions 42 are formed is about 5 μm or greater, and more preferably, about 8 μm or greater or about 10 μm or greater. The surface roughness in the area where the first electrode regions 42 are formed is about 40 μm or smaller, and more preferably, about 35 μm or smaller or about 30 μm or smaller. The surface roughness in the area where the first electrode regions 42 are formed may be about 5 to 40 μm. When the surface roughness is within this range, the bonding strength of the first electrode regions 42 to the body 10 is further improved.

The surface roughness in the area where the second electrode regions 44 are formed is about 1 μm or greater, and more preferably, about 3 μm or greater or about 5 μm or greater. The surface roughness in the area where the second electrode regions 44 are formed is about 20 μm or smaller, and more preferably, about 15 μm or smaller or about 10 μm or smaller. The surface roughness in the area where the second electrode regions 44 are formed may be about 1 to 20 μm. When the surface roughness is within this range, the bonding strength of the second electrode regions 42 to the protection layer is further improved, thereby further enhancing the adhesion strength of the inductor 100 to a mounting substrate.

The ratio of the surface roughness in the area where the first electrode regions 42 are formed to that in the second electrode regions 44 is about 1.5 or higher, and more preferably, about 2.0 or higher or about 5.0 or higher. The ratio of the surface roughness is about 10 or lower, and more preferably, about 8.0 or lower or about 6.0 or lower. When the ratio of the surface roughness is within this range, the bonding strength of the first electrode regions 42 to the body 10 is further increased.

In the inductor 100, the first R-chamfered section 51 is formed at the ridge portion between each end surface 57 and the bottom surface 55 of the body 10, while the second R-chamfered section 52 is formed at the ridge portion between each end surface 57 and the corresponding side surface 58 of the body 10. The distance of the outer edge of the first R-chamfered section 51 between the end surface 57 and the bottom surface 10 is shorter than that of the second R-chamfered section 52 between the end surface 57 and the side surface 58. That is, in the inductor 100, the radius of curvature $r_1$ for implementing arc approximation to determine the outer peripheral configuration of the first R-chamfered section 51 in a cross section perpendicular to the bottom surface 55 and the end surface 57 is smaller than the radius of curvature $r_2$ for implementing arc approximation to determine the outer peripheral configuration of the second R-chamfered section 52 in a cross section perpendicular to the end surface 57 and the side surface 58. A smaller radius of curvature $r_1$ of the first R-chamfered section 51 can reduce the occurrence of the tombstone phenomenon in which an inductor pivots with one side soldered to a mounting substrate and the other side standing up when the inductor is mounted on the substrate. A larger radius of curvature $r_2$ of the second R-chamfered section 52 can reduce the surface tension occurring when the second electrode regions 44 are formed by dipping. This can reduce the amount of second electrode region 44 extending to the side surface 58 of the body 10.

The radius of curvature $r_1$ of the first R-chamfered section 51 is about 20 μm or larger, and more preferably, about 25 μm or larger or about 30 μm or larger. The radius of curvature $r_1$ is about 150 μm or smaller, and more preferably, about 100 μm or smaller or about 80 μm or smaller. The radius of curvature $r_1$ may be about 20 to 150 μm. When the radius of curvature $r_1$ is within this range, the occurrence of the above-described tombstone phenomenon can be reduced more effectively.

The radius of curvature $r_2$ of the second R-chamfered section 52 is about 50 μm or larger, and more preferably, 80 μm or larger or about 100 μm or larger. The radius of curvature $r_2$ is about 200 μm or smaller, and more preferably, about 180 μm or smaller or about 160 μm or smaller. The radius of curvature $r_2$ may be about 50 to 200 μm. When the radius of curvature $r_2$ is within this range, the surface tension of the second electrode region 44 during its formation by pasting in the direction of the side surface 58 can be reduced, thereby decreasing the amount of second electrode region 44 extending toward the side surface 58.

The ratio ($r_2/r_1$) of the radius of curvature $r_2$ of the second R-chamfered section 52 to the radius of curvature $r_1$ of the first R-chamfered section 51 is higher than 1, and more preferably, about 1.5 or higher or about 2.5 or higher. The ratio ($r_2/r_1$) of the radius of curvature is about 10 or lower, and more preferably, about 5 or lower or about 3 or lower. The ratio ($r_2/r_1$) of the radius of curvature may be higher than 1 and 10 or lower. When the ratio ($r_2/r_1$) of the radius of curvature is within this range, the occurrence of the tombstone phenomenon can be reduced and the amounts of second electrode regions 44 extending toward the side surfaces 58 can be decreased in a well-balanced manner.

Figure 2B:
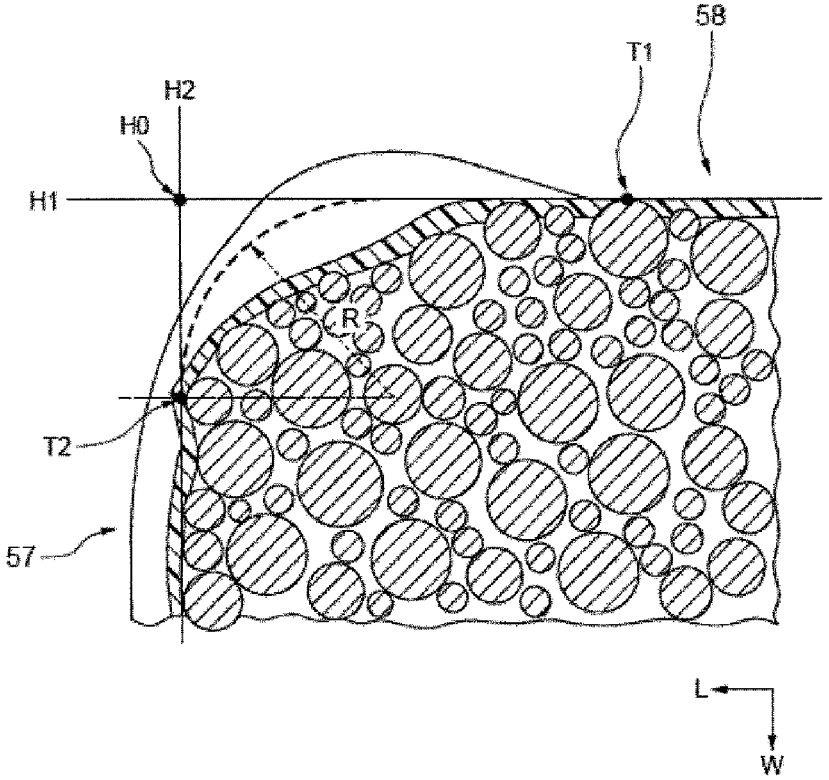
FIG. 2B is a partially sectional view of a second R-chamfered section and its vicinity to explain how to measure the radius of curvature.

The radius of curvature can be measured in the following manner. An image of a cross section on which the radius of curvature will be measured is taken by using a digital microscope (VHX-6000 made by KEYENCE CORPORATION, for example) at a magnification factor of 1000, for example. Then, the radius of curvature is measured by using accompanying software. FIG. 2B is an enlarged sectional view of the second R-chamfered section 52 and its vicinity to explain how to measure the radius of curvature. The cross section shown in FIG. 2B is perpendicular to the end surface 57 and the side surface 58. As shown in FIG. 2B, two auxiliary lines H1 and H2 perpendicular to each other and parallel with the corresponding surfaces of the body 10 are drawn such that they contact the magnetic powders in the second R-chamfered section 52 exposed at the highest positions from the surfaces of the body 10. A contact point T1 is set between the auxiliary line H1 and the second R-chamfered section 52, while a contact point T2 is set between the auxiliary line H2 and the second R-chamfered section 52. A smaller one of the distance between the contact point T1 and an intersection point H0 between the two auxiliary lines H1 and H2 and the distance between the contact point T2 and the intersection point H0 is set as the radius of curvature. FIG. 2B shows how to measure the radius of curvature of the second R-chamfered section 52. The radius of curvature of each of the first and third R-chamfered sections 51 and 53 can be determined in a similar manner.

Manufacturing Method of Inductor

A manufacturing method of the inductor 100 includes a core preparing step, a coil forming step, an extending step, a forming (metalworking) step, a molding and curing step, a polishing step, a protection layer forming step, a protection layer removing step, a first electrode region forming step, a second electrode region forming step, and an outer electrode forming step, for example. In the core preparing step, a magnetic base including a base unit and a columnar unit and containing magnetic powder is prepared. In the coil forming step, a winding portion of a coil is formed by winding a conductor around the columnar unit of the magnetic base. In the extending step, flat portions are formed at the forward ends of lead-out portions extending from the winding portion of the coil. In the forming step, the flat portions of the lead-out portions are disposed on the bottom surface of the magnetic base. In the molding and curing step, a magnetic exterior unit that covers the coil and the magnetic base is formed so as to fabricate a body. In the polishing step, the ridge portions of the body are polished. In the protection layer forming step, a protection layer is formed on the surface of the body. In the protection layer removing step, the protection layer is removed from part of the bottom surface of the body. In the first electrode region forming step, first electrode regions are formed in the areas where the protection layer on the bottom surface is removed. In the second electrode region forming step, second electrode regions are formed on the end surfaces of the body. In the outer electrode forming step, a plated layer is formed on the first and second electrode regions.

The magnetic base prepared in the core preparing step includes the planar base unit formed substantially in a rectangular shape and the columnar unit disposed substantially perpendicularly to the base unit. The magnetic base is fabricated as follows. A magnetic material containing magnetic powder and a resin is charged into a cavity in a die having a desired shape. The magnetic material is heated to a softening temperature of the resin or higher (about 60 to 150° C., for example), and is pressurized and molded at a pressure of about 10 to 1000 MPa for several seconds to several minutes while maintaining this temperature, thereby forming a preformed molding. The preformed molding is then heated to a curing temperature of the resin or higher (about 100 to 220° C., for example) so as to cure the resin. The magnetic base is fabricated in this manner. The internal configuration of portions of the die corresponding to the corners of the base unit is curved as viewed from the thickness direction of the base unit. In the core preparing step, the resin may be semi-cured to form the magnetic base. Semi-curing of the resin is implemented by adjusting the heating temperature and/or the thermal processing time.

In the coil forming step, the winding portion of the coil is formed by winding a conductor around the columnar unit of the magnetic base. As the conductor, flat wire having a substantially rectangular cross section and including a coating layer and a self-fusion-bonding layer is used. The winding portion is formed by winding the conductor in two stages such that the end portions of the conductor are positioned at the outermost peripheral side and the inner portions of the conductor are connected with each other at the innermost peripheral side.

In the extending step, the forward ends of the lead-out portions extending from the outermost peripheral side of the winding portion of the coil are squashed in the thickness direction of the conductor so as to form flat portions having a larger width than the line width of the conductor forming the winding portion.

In the forming (metalworking) step, the lead-out portions are twisted on the base unit at about 90° such that the flat surfaces of the conductor become substantially parallel with the surface of the base unit. The lead-out portions are then bent at notches provided at one side surface of the base unit and extend toward the bottom surface of the base unit so as to be placed thereon.

In the molding and curing step, the magnetic exterior unit that covers the coil and the magnetic base is fabricated in the following manner. The magnetic base having the coil fixed therein is housed within a cavity of a die such that the bottom surface of the base unit faces downward. On the bottom surface of the cavity, projecting portions are provided to extend in the width W direction of the body. The magnetic base is housed within the cavity so that the projecting portions of the cavity can be disposed between the flat portions of the conductor, and the bottom surface of the base unit is brought into contact with the bottom surface of the cavity. The corners of the side walls of the cavity are curved to form second R-chamfered sections. The curved surfaces of the cavity have a larger radius of curvature than that of curved surfaces to be formed at the ridge portions of the body by barrel polishing, which will be discussed later. Then, a magnetic material having magnetic powder and a resin is charged into the die. Within the cavity of the die, the magnetic material is heated to a softening temperature of the resin or higher (about 60 to 150° C., for example) and is pressurized at a pressure of about 10 to 1000 MPa while maintaining this temperature. The magnetic material is then heated to a curing temperature of the resin or higher (about 100 to 220° C., for example) so that it can be molded and cured. After this process, a recessed portion, which serves as a standoff, is formed between outer electrodes on the mounting surface. As a result, a body in which the coil is embedded in the magnetic member containing the magnetic powder and resin is formed. The magnetic material may be molded first and then be cured.

In the polishing step, the body is barrel-polished, thereby forming first R-chamfered sections at the ridge portions of the body. As discussed above, the second R-chamfered sections are already formed in accordance with the shape of the curved surfaces of the cavity in the molding and curing step. The radius of curvature of the second R-chamfered sections is larger than that of the first R-chamfered sections.

In the protection layer forming step, a protection layer is formed on the entire surfaces of the body. The protection layer is formed by applying a certain composition which forms a protection layer to the surfaces of the body by dipping, spraying, or screen-printing, for example. The composition may include a resin. As the resin, a thermosetting resin, such as an epoxy resin, a polyimide resin, and a phenolic resin, or a thermoplastic resin, such as a polyethylene resin and a polyamide resin, may be used. The composition may also include a non-conductive filler, such as silicon oxide or titanium oxide, in addition to a resin. The composition may contain insulating metal oxide, such as water glass (sodium silicate), instead of a resin.

In the protection layer removing step, the protection layer is removed from the areas on the bottom surface of the body where the first electrode regions will be formed. When removing the protection layer, the coating layer of the conductor may also be removed from the flat portions of the conductor exposed on the protection layer, and part of the resin forming the magnetic member around the flat portions may also be eliminated. As a result of removing the protection layer and part of the resin forming the magnetic member, the surface roughness of the bottom surface on which the first electrode regions are located becomes greater than that of the protection layer on the end surfaces on which the second electrode regions are located. Laser irradiation, blasting, or polishing, for example, may be used to remove the protection layer.

In the first electrode region forming step, a first conductive paste containing conductive particles and a binder is applied to the areas on the mounting surface of the body where the protection layer is removed and external terminals will be formed, thereby forming first electrode regions. Examples of the conductive particles contained in the first conductive paste are metal particles, such as silver particles and copper particles. The first conductive paste may be applied by screen-printing, transferring, or jet-dispensing, for example. The applied first conductive paste may be cured, if necessary.

In the second electrode region forming step, a second conductive paste containing conductive particles is applied to the end surfaces of the body and their peripheral areas where external terminals will be formed, thereby forming second electrode regions. The second electrode regions may be formed to be electrically connected to the first electrode regions. Examples of the conductive particles contained in the second conductive paste are metal particles, such as silver particles and copper particles. The conductive particles contained in the second conductive paste are larger than those in the first conductive paste. The second conductive paste may be applied by dipping or screen-printing, for example. The applied second conductive paste may be cured, if necessary. If dipping is used for applying the second conductive paste, the second electrode regions can be formed, not only on the end surfaces, but also in the adjacent areas, in accordance with the depth of the body to be dipped in the second conductive paste.

In the outer electrode forming step, a plated layer is formed on the first and second electrode regions so as to form outer electrodes. The plated layer is formed by first nickel-plating the first and second electrode regions and then by tin-plating the nickel-plated portion. Barrel-plating, for example, is used for forming the plated layer. The first electrode regions may be formed by directly copper-plating part of the surface of the body, instead of applying a conductive paste.

Second Embodiment

Figure 4A:
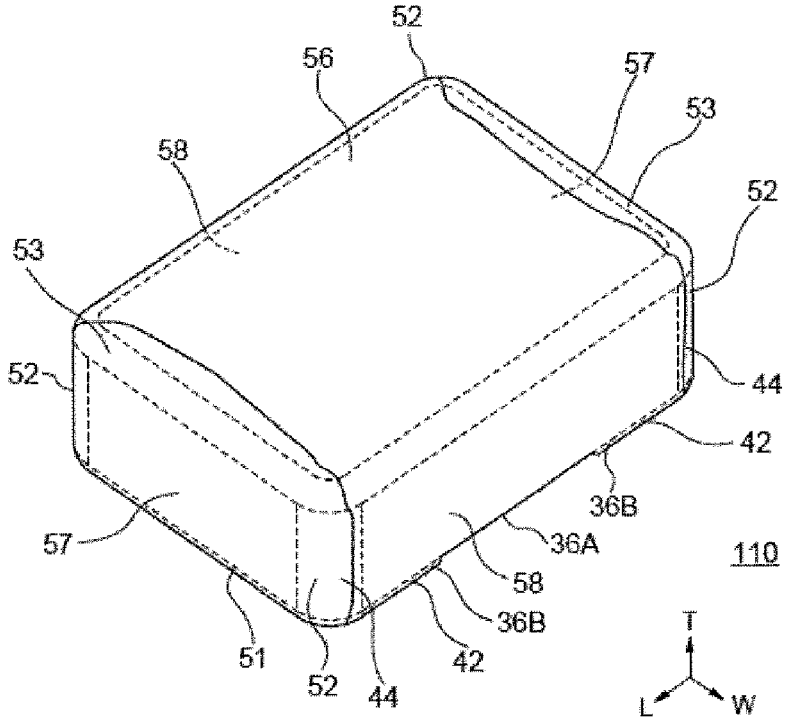
FIG. 4A is a perspective view of an inductor according to a second embodiment when the top surface is seen obliquely from above.
Figure 4B:
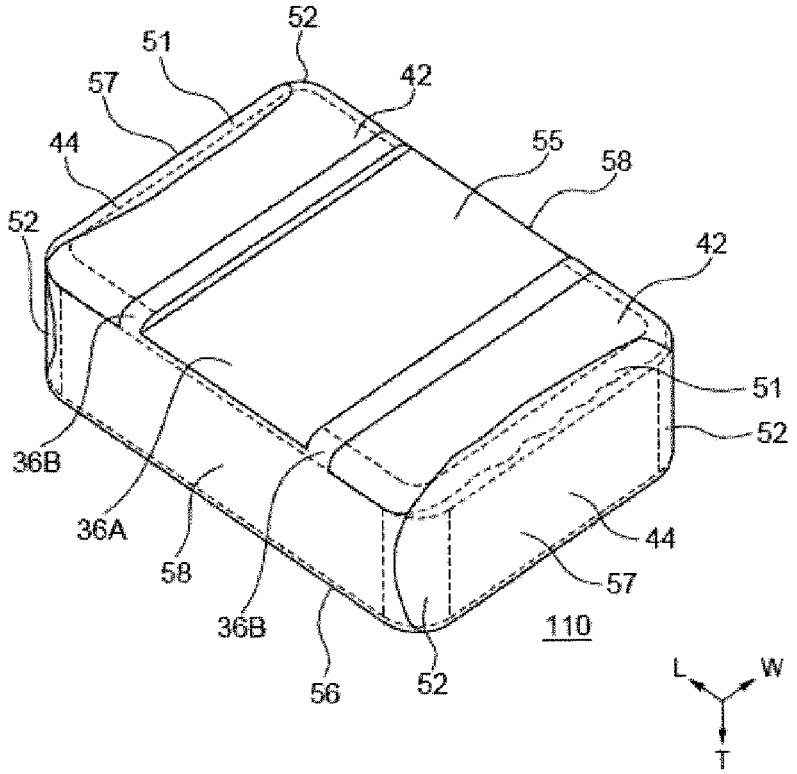
FIG. 4B is a perspective view of the inductor according to the second embodiment when the mounting surface is seen obliquely from above.

An inductor 110 according to a second embodiment will be described below with reference to FIGS. 4A and 4B. FIG. 4A is a perspective view of the inductor 110 when the top surface is seen obliquely from above. FIG. 4B is a perspective view of the inductor 110 when the mounting surface is seen obliquely from above. Unlike in FIG. 1B, the end portions of the lead-out portions are not seen through in FIG. 4B.

The inductor 110 is configured similarly to the inductor 100 of the first embodiment, except for the areas where the second electrode regions 44 are formed. More specifically, in the inductor 110, the second electrode region 44 extends on the protection layer on each end surface 57, on the first R-chamfered section 51 at the ridge portion between the bottom surface 55 and each end surface 57, on at least part of the bottom surface 55, on the third R-chamfered section 53 at the ridge portion between the top surface 56 and each end surface 57, on at least part of the top surface 56, and on part of the second R-chamfered sections 52 at the ridge portions between the side surfaces 58 and each end surface 57. However, the second electrode regions 44 are not formed on the side surfaces 58 of the body 10. Omitting to form the second electrode regions 44 on the side surfaces 58 achieves higher-density mounting of the inductor 110 in the direction of the side surfaces 58.

The inductor 110 can be manufactured as follows. When forming the second electrode regions 44 by dipping using a conductive paste, the depth of the body 10 to be dipped in the conductive paste is determined so that the end surfaces 57, part of the bottom surface 55, and part of the second R-chamfered sections 52 are dipped.

Third Embodiment

Figure 5A:
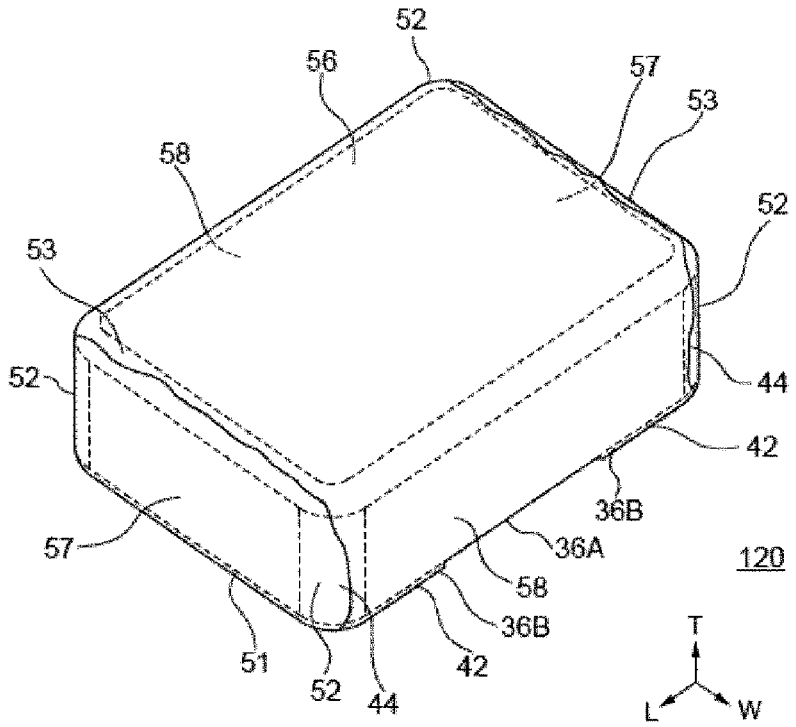
FIG. 5A is a perspective view of an inductor according to a third embodiment when the top surface is seen obliquely from above.
Figure 5B:
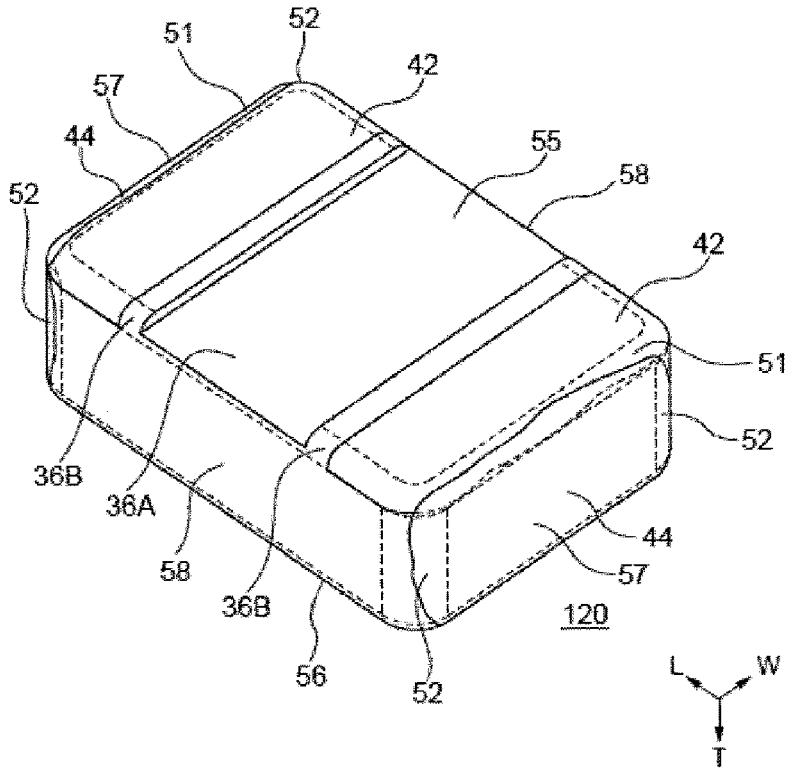
FIG. 5B is a perspective view of the inductor according to the third embodiment when the mounting surface is seen obliquely from above.

An inductor 120 according to a third embodiment will be described below with reference to FIGS. 5A and 5B. FIG. 5A is a perspective view of the inductor 120 when the top surface is seen obliquely from above. FIG. 5B is a perspective view of the inductor 120 when the mounting surface is seen obliquely from above. Unlike in FIG. 1B, the end portions of the lead-out portions are not seen through in FIG. 5B.

The inductor 120 is configured similarly to the inductor 100 of the first embodiment, except for the areas where the second electrode regions 44 are formed. More specifically, in the inductor 120, the second electrode region 44 extends on the protection layer on each end surface 57, on part of the first R-chamfered section 51 at the ridge portion between the bottom surface 55 and each end surface 57, and on part of the second R-chamfered sections 52 at the ridge portions between the side surfaces 58 and each end surface 57. However, on the bottom surface 55, the top surface 56, and the side surfaces 58 of the body 10, the second electrode regions 44 are not formed. Omitting to form the second electrode regions 44 on the bottom surface 55 can further improve the flatness of the mounting surface of the inductor 120. Additionally, even if a metal shielding is disposed above the inductor 120, short-circuiting is less likely to occur.

In the inductor 120, the first and second electrode regions 42 and 44 may not necessarily be directly connected with each other, and may be connected via a plated layer. The adhesion strength between a plated layer and the body 10 is higher than the bonding strength between each of the first and second electrode regions 42 and 44 and the body 10. This can enhance the adhesion strength of the inductor 120 to a mounting substrate.

The inductor 120 can be manufactured as follows. When forming the second electrode regions 44 by dipping using a conductive paste, the depth of the body 10 to be dipped in the conductive paste is determined so that part of the first R-chamfered section 51 between each end surface 57 and the bottom surface 55 and part of the second R-chamfered sections 52 between each end surface 57 and the side surfaces 58 are dipped.

Fourth Embodiment

Figure 6A:
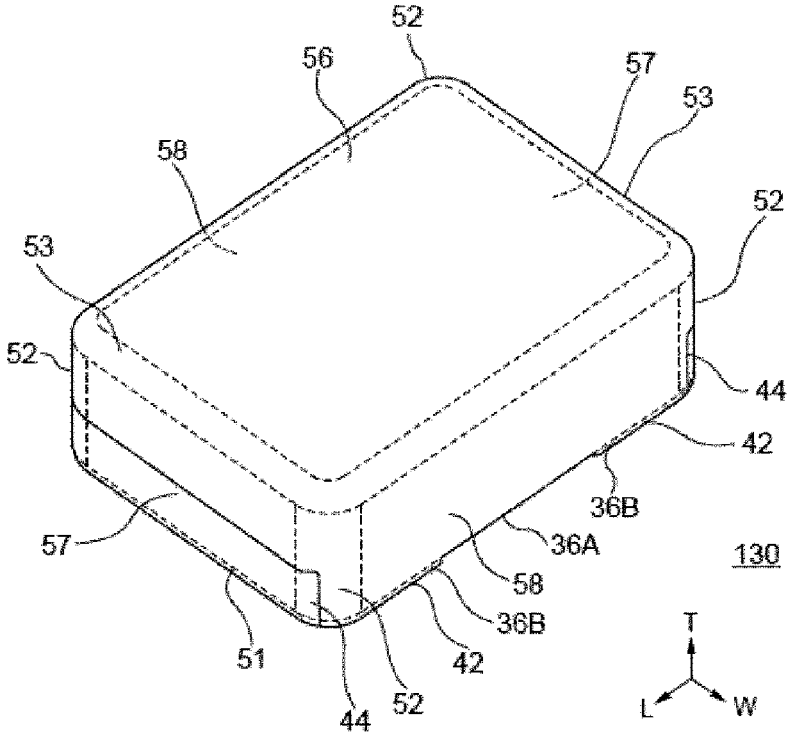
FIG. 6A is a perspective view of an inductor according to a fourth embodiment when the top surface is seen obliquely from above.
Figure 6B:
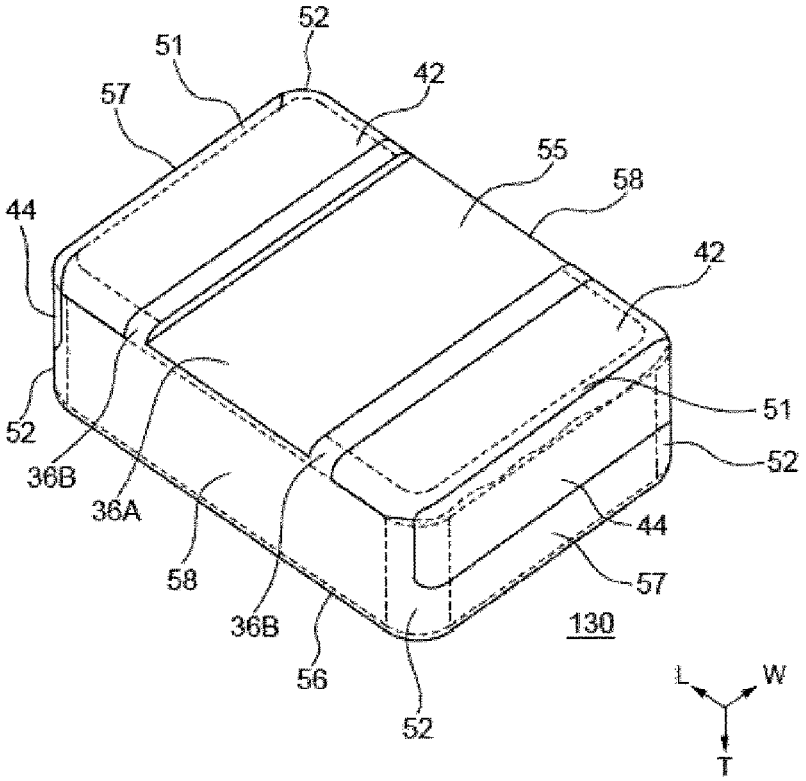
FIG. 6B is a perspective view of the inductor according to the fourth embodiment when the mounting surface is seen obliquely from above.

An inductor 130 according to a fourth embodiment will be described below with reference to FIGS. 6A and 6B. FIG. 6A is a perspective view of the inductor 130 when the top surface is seen obliquely from above. FIG. 6B is a perspective view of the inductor 130 when the mounting surface is seen obliquely from above. Unlike in FIG. 1B, the end portions of the lead-out portions are not seen through in FIG. 6B.

The inductor 130 is configured similarly to the inductor 100 of the first embodiment, except for the areas where the second electrode regions 44 are formed. More specifically, in the inductor 130, the second electrode region 44 extends on part of each end surface 57 closer to the bottom surface 55, on part of the first R-chamfered section 51 at the ridge portion between the bottom surface 55 and each end surface 57, and on part of the second R-chamfered sections 52 at the ridge portions between the side surfaces 58 and each end surface 57. However, on the bottom surface 55, the top surface 56, and the side surfaces 58 of the body 10, the second electrode regions 44 are not formed. The protection layer is exposed on part of each end surface 57 closer to the top surface 56. In the inductor 130, while the adhesion strength of the inductor 130 to a mounting substrate is achieved, short-circuiting is even less likely to occur even if a metal shielding is disposed above the inductor 130.

The inductor 130 can be manufactured as follows. The second electrode regions 44 are formed by applying the second conductive paste to certain positions of the body 10 with screen-printing or transferring.

Fifth Embodiment

Figure 7A:
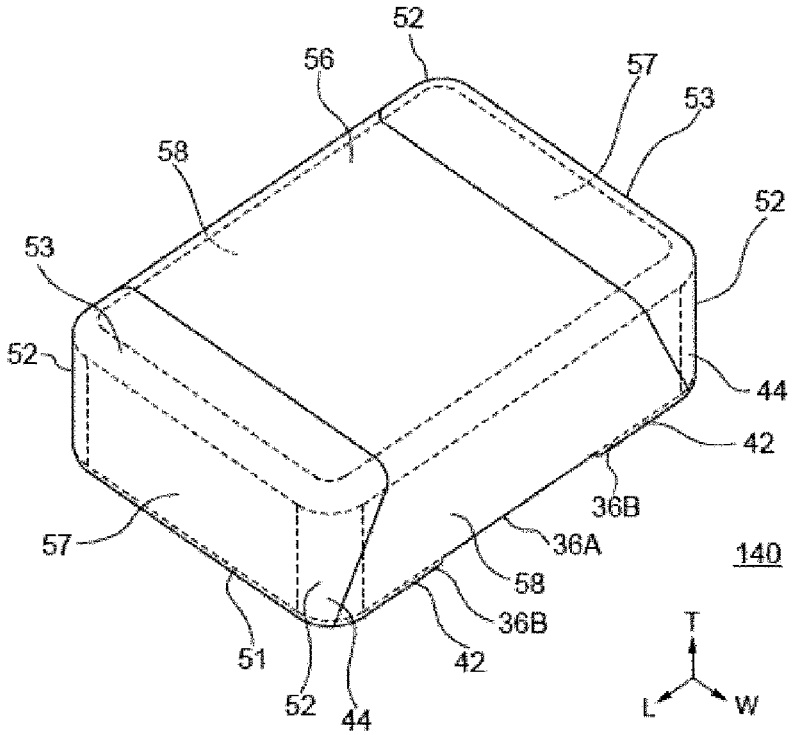
FIG. 7A is a perspective view of an inductor according to a fifth embodiment when the top surface is seen obliquely from above.
Figure 7B:
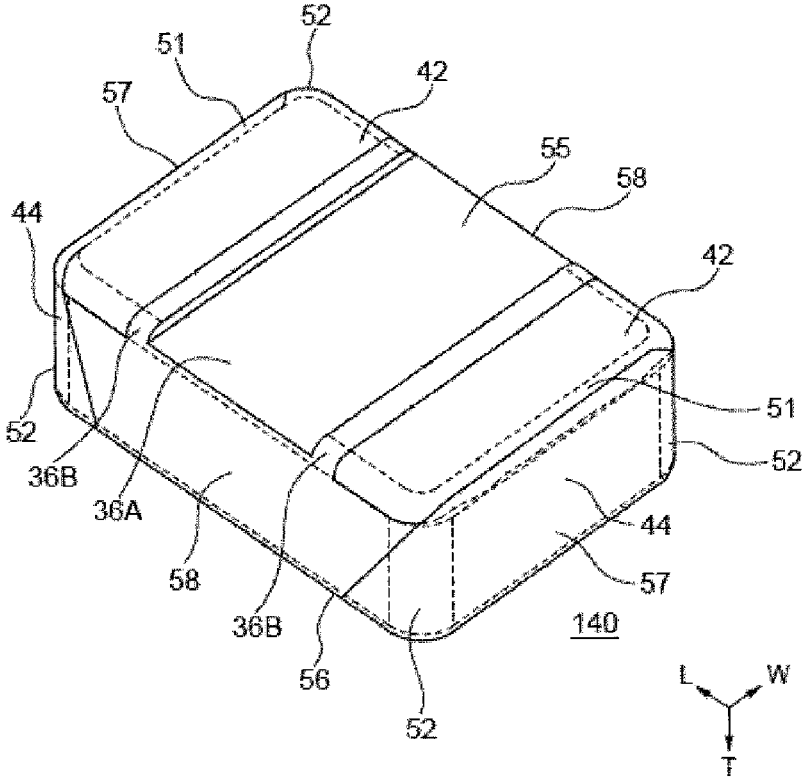
FIG. 7B is a perspective view of the inductor according to the fifth embodiment when the mounting surface is seen obliquely from above.

An inductor 140 according to a fifth embodiment will be described below with reference to FIGS. 7A and 7B. FIG. 7A is a perspective view of the inductor 140 when the top surface is seen obliquely from above. FIG. 7B is a perspective view of the inductor 140 when the mounting surface is seen obliquely from above. Unlike in FIG. 1B, the end portions of the lead-out portions are not seen through in FIG. 7B.

The inductor 140 is configured similarly to the inductor 100 of the first embodiment, except for the areas where the second electrode regions 44 are formed. More specifically, in the inductor 140, the second electrode region 44 extends on the protection layer on each end surface 57, on at least part of the first R-chamfered section 51 at the ridge portion between the bottom surface 55 and each end surface 57, on the third R-chamfered section 53 at the ridge portion between the top surface 56 and each end surface 57, on part of the top surface 56, on part of the second R-chamfered sections 52 at the ridge portions between the side surfaces 58 and each end surface 57, and on part of the side surfaces 58. However, the second electrode regions 44 are not formed on the bottom surface 55 of the body 10. Omitting to form the second electrode regions 44 on the bottom surface 55 can further improve the flatness of the mounting surface of the inductor 140. Additionally, increasing the area of the second electrode regions 44 can further enhance the adhesion strength of the inductor 140 to a mounting substrate.

The inductor 140 can be manufactured as follows. When forming each of the second electrode regions 44 by dipping using a conductive paste, the end surface 57 is tilted with respect to the liquid surface of the conductive paste and is dipped therein so that the distance from the end surface 57 closer to the top surface 56 to the forward end of the second electrode region 44 becomes greater than that from the end surface 57 closer to the bottom surface 55 to the forward end of the second electrode region 44.

In the above-described embodiments, the conductor forming the coil 20 has a substantially rectangular cross section. However, a conductor having a substantially circular or elliptical cross section may be used. Although the winding type of the winding portion 22 of the coil 20 is a winding in the embodiments, another type, such as edgewise winding, may be used. The body 10 may be formed by pressure-molding a composite material having the coil 20 embedded therein. The protection layer 12 may be made of an inorganic material, such as water glass, instead of a resin composition containing a filler and a resin. The recessed portion 36A formed on the bottom surface 55 of the body 10 may have a semi-circular shape in the height T direction as viewed from the width W direction of the body 10. The sectional configuration of the columnar unit 32 of the magnetic base 30 in the direction parallel with the base unit 34 may be a substantially circle, ellipse, or polygon having corners to be chamfered.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a coil including a winding portion and a lead-out portion, the winding portion including a wound conductor, the lead-out portion extending from the winding portion;

a body comprising a magnetic member including magnetic powder and a resin, and that encloses the coil;

a protection layer disposed on a surface of the body; and an outer electrode electrically connected to the lead-out portion, wherein the body has a bottom surface, a top surface, two end surfaces, two side surfaces, and first and second R-chamfered sections, the bottom surface being configured as a mounting surface, the top surface opposing the bottom surface, the two end surfaces opposing each other and being substantially perpendicular to the bottom surface, the two side surfaces opposing each other and being substantially perpendicular to the bottom surface and the end surfaces, the first R-chamfered section being disposed at a ridge portion between the bottom surface and each of the end surfaces, the second R-chamfered section being disposed at a ridge portion between each of the end surfaces and the corresponding side surface, the outer electrode includes first and second electrode regions, the first electrode region is at least located on at least part of the bottom surface and is electrically connected to the lead-out portion, the second electrode region is at least located on at least part of the protection layer disposed on each of the end surfaces, and surface roughness of part of the bottom surface where the first electrode region is disposed is greater than surface roughness of the protection layer on each of the end surfaces where the second electrode region is disposed.

2. The inductor according to claim 1,
wherein
the second electrode region extends
on the protection layer disposed on each of the end surfaces,
on the first R-chamfered section continuing to each of the end surfaces,
on part of the bottom surface continuing to the first R-chamfered section,
on the second R-chamfered sections continuing to each of the end surfaces, and
on part of each of the side surfaces continuing to the second R-chamfered section.

3. The inductor according to claim 1,
wherein
the second electrode region extends
on the protection layer disposed on each of the end surfaces,
on the first R-chamfered section continuing to each of the end surfaces,
on part of the bottom surface continuing to the first R-chamfered section, and
on part of the second R-chamfered sections continuing to each of the end surfaces.

4. The inductor according to claim 1,
wherein
the second electrode region extends
on the protection layer disposed on each of the end surfaces,
on part of the first R-chamfered section continuing to each of the end surfaces, and
on part of the second R-chamfered sections continuing to each of the end surfaces.

5. The inductor according to claim 4, wherein:
the first electrode region extends on part of the bottom surface and on the first R-chamfered section continuing to the bottom surface; and
the second electrode region is electrically connected to the first electrode region and to the first R-chamfered section.

6. The inductor according to claim 1, wherein
the second electrode region is absent from the top surface.

7. The inductor according to claim 1, wherein
the second electrode region is disposed on part of each of the end surfaces located closer to the bottom surface, and
the protection layer is exposed on part of each of the end surfaces located closer to the top surface.

8. The inductor according to claim 1, wherein
the second electrode region extends on the protection layer disposed on each of the end surfaces, on the first R-chamfered section continuing to each of the end surfaces, and on part of the top surface.

9. The inductor according to claim 1, wherein
a radius of curvature for implementing arc approximation to determine an outer peripheral configuration of the first R-chamfered section in a cross section perpendicular to the end surfaces and the bottom surface is smaller than a radius of curvature for implementing arc approximation to determine an outer peripheral configuration of the second R-chamfered section in a cross section perpendicular to the end surfaces and the side surfaces.

10. The inductor according to claim 2, wherein
the second electrode region is absent from the top surface.

11. The inductor according to claim 3, wherein
the second electrode region is absent from the top surface.

12. The inductor according to claim 4, wherein
the second electrode region is absent from the top surface.

13. The inductor according to claim 5, wherein
the second electrode region is absent from the top surface.

14. The inductor according to claim 2, wherein
the second electrode region is disposed on part of each of the end surfaces located closer to the bottom surface, and
the protection layer is exposed on part of each of the end surfaces located closer to the top surface.

15. The inductor according to claim 3, wherein
the second electrode region is disposed on part of each of the end surfaces located closer to the bottom surface, and
the protection layer is exposed on part of each of the end surfaces located closer to the top surface.

16. The inductor according to claim 4, wherein
the second electrode region is disposed on part of each of the end surfaces located closer to the bottom surface, and
the protection layer is exposed on part of each of the end surfaces located closer to the top surface.

17. The inductor according to claim 5, wherein
the second electrode region is disposed on part of each of the end surfaces located closer to the bottom surface, and
the protection layer is exposed on part of each of the end surfaces located closer to the top surface.

18. The inductor according to claim 2, wherein
a radius of curvature for implementing arc approximation to determine an outer peripheral configuration of the first R-chamfered section in a cross section perpendicular to the end surfaces and the bottom surface is smaller than a radius of curvature for implementing arc approximation to determine an outer peripheral configuration of the second R-chamfered section in a cross section perpendicular to the end surfaces and the side surfaces.

19. The inductor according to claim 3, wherein
a radius of curvature for implementing arc approximation to determine an outer peripheral configuration of the first R-chamfered section in a cross section perpendicular to the end surfaces and the bottom surface is smaller than a radius of curvature for implementing arc approximation to determine an outer peripheral configuration of the second R-chamfered section in a cross section perpendicular to the end surfaces and the side surfaces.

20. The inductor according to claim 4, wherein
a radius of curvature for implementing arc approximation to determine an outer peripheral configuration of the first R-chamfered section in a cross section perpendicular to the end surfaces and the bottom surface is smaller than a radius of curvature for implementing arc approximation to determine an outer peripheral configuration of the second R-chamfered section in a cross section perpendicular to the end surfaces and the side surfaces.

* * * * *